US012435591B1

(12) United States Patent
Pye et al.

(10) Patent No.: US 12,435,591 B1
(45) Date of Patent: Oct. 7, 2025

(54) RAPID SIDE-TRACK OPERATIONS WITH A DROP-DOWN PIPE CUTTER

(71) Applicant: SAUDI ARABIAN OIL COMPANY, Dhahran (SA)

(72) Inventors: Richard Pye, Dhahran (SA); Amjad Alsharaawi, Dhahran (SA); Ala Edeen Herzallah, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 18/666,178

(22) Filed: May 16, 2024

(51) Int. Cl.
*E21B 29/06* (2006.01)
*E21B 33/16* (2006.01)

(52) U.S. Cl.
CPC ..... *E21B 29/06* (2013.01); *E21B 33/16* (2013.01)

(58) Field of Classification Search
CPC ..... E21B 29/06; E21B 33/16
See application file for complete search history.

(56) References Cited

U.S. PATENT DOCUMENTS 10,119,368 B2 11/2018 Tunget
11,053,741 B1 7/2021 Davis et al.
11,725,458 B2 8/2023 Alzaki et al.
2002/0074120 A1* 6/2002 Scott ..... E21B 43/14 166/117.6
2003/0098152 A1* 5/2003 Kennedy ..... E21B 7/061 175/81
2008/0128128 A1* 6/2008 Vail ..... E21B 4/18 166/241.1
2013/0062055 A1* 3/2013 Tolman ..... E21B 43/116 175/4.51
2021/0054708 A1* 2/2021 Al-Mousa ..... E21B 33/134
2021/0238988 A1* 8/2021 Watkins ..... E21B 47/092
2021/0254456 A1* 8/2021 Zemla ..... E21B 33/068
2022/0065061 A1* 3/2022 Sehsah ..... E21B 47/092
2022/0259924 A1* 8/2022 Alkhowaildi ..... E21B 33/12
2023/0105473 A1* 4/2023 Alzaki ..... E21B 7/061 175/62
2023/0228163 A1* 7/2023 Alzaki ..... E21B 33/127 166/297
2023/0383604 A1* 11/2023 Al-Mousa ..... E21B 23/06

FOREIGN PATENT DOCUMENTS

EP 1878868 A1 1/2008

* cited by examiner

*Primary Examiner* — Taras P Bemko
(74) *Attorney, Agent, or Firm* — Vorys, Sater, Seymour and Pease, LLP

(57) ABSTRACT

A wellbore system includes a drill string extending into a main wellbore and an untethered cutting tool disposed within the drill string. The untethered cutting tool includes at least one cutting element operable to sever the drill string such that an upper portion of the drill string may be withdrawn from the wellbore. A sidetrack tool is integrally coupled to an upper end of the untethered cutting tool. The sidetrack tool may include at least one of a whipstock, a whipstock latch, and a cement plug cup. The sidetrack tool may facilitate drilling a sidetrack wellbore by limiting the number of trips into the main wellbore.

20 Claims, 7 Drawing Sheets

RAPID SIDE-TRACK OPERATIONS WITH A DROP-DOWN PIPE CUTTER

FIELD OF THE DISCLOSURE

The present disclosure relates generally to subterranean drilling operations, and more particularly, drilling operations in which a sidetrack wellbore is drilled above a stuck drill pipe in a main wellbore.

BACKGROUND OF THE DISCLOSURE

Wellbores may be drilled to recover natural deposits of oil and gas, as well as other desirable materials that are trapped in subterranean geological formations. A common method for drilling a wellbore is rotary drilling, which uses a drill bit attached to the end of a long string of jointed hollow drill pipe called a "drill string". In some applications, the drill string may be rotated by a motorized turn table at the surface to cause the drill bit to rotate and extend the length of the wellbore. Cuttings from the drill bit may be carried to the surface by a drilling fluid circulated through the wellbore. The drilling fluid may be pumped downhole through the drill string and may be discharged through nozzles in the drill bit, which cools and lubricates the drill bit. The discharged drilling fluid may then carry the drill cuttings to the surface through an annulus between the drill string and a wall of the borehole.

In some instances, the drill string may get "stuck" in the wellbore such that a drilling crew is unable to continue drilling or to pull the drill string up out of the wellbore. A drill string may become stuck for various reasons. For example, an accumulation of cuttings in the wellbore may prevent the drill string from turning, or a curvature of the wellbore or the drill string itself may cause the drill string to frictionally engage a wall of the wellbore over an extended length. Additionally, differential sticking may be caused by high wellbore pressures and low reservoir pressures. Mechanical, chemical and hydraulic tools are often used to free a stuck drill string, but in some instances, the stuck drill string may simply be severed and drilling may continue along a "side-track" wellbore extending from the original wellbore. Initiating a side-track wellbore may be labor and time intensive, often requiring several trips in and out of the wellbore.

SUMMARY OF THE DISCLOSURE

Various details of the present disclosure are hereinafter summarized to provide a basic understanding. This summary is not an extensive overview of the disclosure and is neither intended to identify certain elements of the disclosure, nor to delineate the scope thereof. Rather, the primary purpose of this summary is to present some concepts of the disclosure in a simplified form prior to the more detailed description that is presented hereinafter.

According to an embodiment consistent with the present disclosure, a wellbore system includes a drill string extending into a main wellbore and an untethered cutting tool disposed within the drill string. The untethered cutting tool includes a locking unit operable to fix a location of the untethered cutting tool in the drill string and at least one cutting element operable to sever the drill string. The wellbore system also includes a sidetrack tool integrally coupled to an upper end of the untethered cutting tool, and the sidetrack tool includes at least one of the group consisting of a whipstock, a whipstock latch, and a cement plug cup.

According to another embodiment consistent with the present disclosure, a method for forming a sidetrack wellbore includes (a) deploying an untethered cutting tool into a drill string extending into a main wellbore, (b) fixing a location of the untethered cutting tool in the drill string with a locking unit of the untethered cutting tool, (c) severing the drill string with at least one cutting element of the untethered cutting tool, (d) withdrawing an upper portion of the drill string from the wellbore, and (e) engaging a sidetrack tool integrally coupled to an upper end of the untethered cutting tool with a sidetrack drilling assembly, a whipstock latch seat or a cement plug to direct the sidetrack drilling assembly laterally from the main wellbore to form the sidetrack wellbore.

According to still another embodiment consistent with the present disclosure, an untethered sidetrack tool assembly includes an untethered cutting tool movable through a drill string uncoupled from any conveyance. The untethered cutting tool includes a locking unit operable to fix a location of the untethered cutting tool with respect to the drill string and at least one cutting element operable to sever the drill string. The untethered cutting tool assembly also includes a sidetrack tool integrally coupled to an upper end of the untethered cutting tool. The sidetrack tool includes at least one of the group consisting of a whipstock, a whipstock latch, and a cement plug cup.

Any combinations of the various embodiments and implementations disclosed herein can be used in a further embodiment, consistent with the disclosure. These and other aspects and features can be appreciated from the following description of certain embodiments presented herein in accordance with the disclosure and the accompanying drawings and claims.

DETAILED DESCRIPTION

Figure 1C:
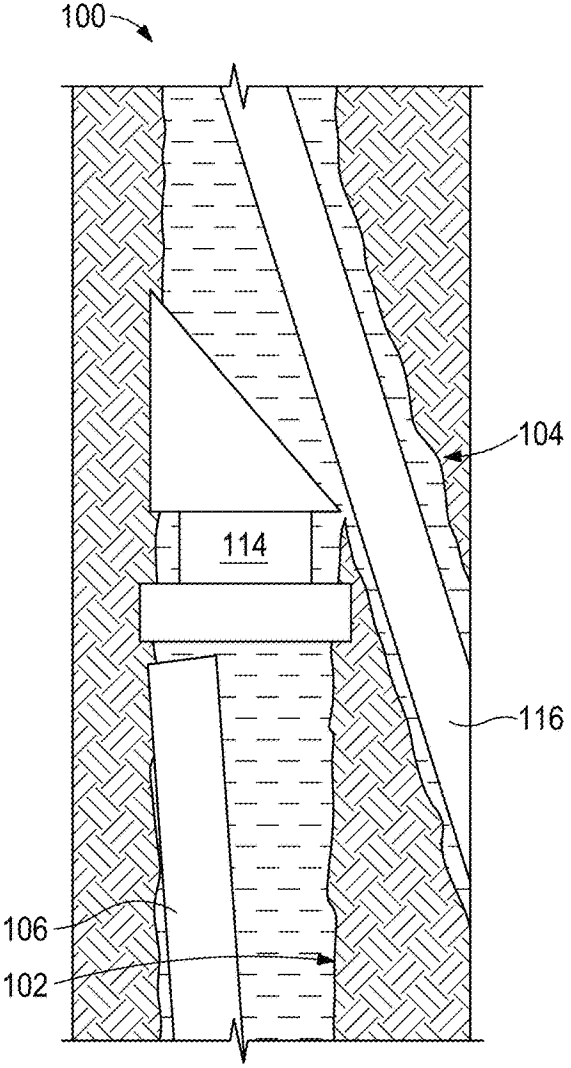
FIGS. 1A-1C are sequential schematic views illustrating progressive steps of a downhole operation in which a sidetrack wellbore is drilled from a stuck drill string in a main wellbore using a tethered pipe cutter and an open hole whipstock.

Embodiments of the present disclosure will now be described in detail with reference to the accompanying Figures. Like elements in the various figures may be denoted by like reference numerals for consistency. Further, in the following detailed description of embodiments of the present disclosure, numerous specific details are set forth in order to provide a more thorough understanding of the claimed subject matter. However, it will be apparent to one of ordinary skill in the art that the embodiments disclosed herein may be practiced without these specific details. In other instances, well-known features have not been described in detail to avoid unnecessarily complicating the description. Additionally, it will be apparent to one of ordinary skill in the art that the scale of the elements presented in the accompanying Figures may vary without departing from the scope of the present disclosure.

Embodiments in accordance with the present disclosure generally relate to systems and methods for downhole operations including drilling a sidetrack wellbore from a stuck drill string in a main wellbore. The downhole operations may include deploying an autonomous cutting tool into the stuck drill pipe and securing the autonomous cutting tool to an interior surface of the drill pipe at a desired depth above a sticking point. The autonomous cutting tool may then be activated to sever the drill pipe and thereby free an upper portion of the drill pipe. The freed upper portion of the drill pipe may be withdrawn from the wellbore, and a sidetrack tool integrated onto a top of the autonomous cutting tool may be used to facilitate drilling a sidetrack wellbore.

The sidetrack tool may include a pivoting whipstock that may be unfolded to direct a sidetrack drilling assembly from the main wellbore. One or more hinge points may be provided on the pivoting whipstock so that the pivoting whipstock may maintain a sufficiently narrow profile while being deployed through the drill pipe on top of the untethered cutting tool and to unfold to a sufficiently broad profile to appropriately direct the sidetrack drilling assembly. The sidetrack tool may alternatively include a whipstock latch, which may receive and secure a stationary or pivoting whipstock thereon. The sidetrack tool may also include an inflatable cement plug cup, which may be inflated to permit a cement kick off plug to be established above the untethered cutting tool.

Figure 1B:
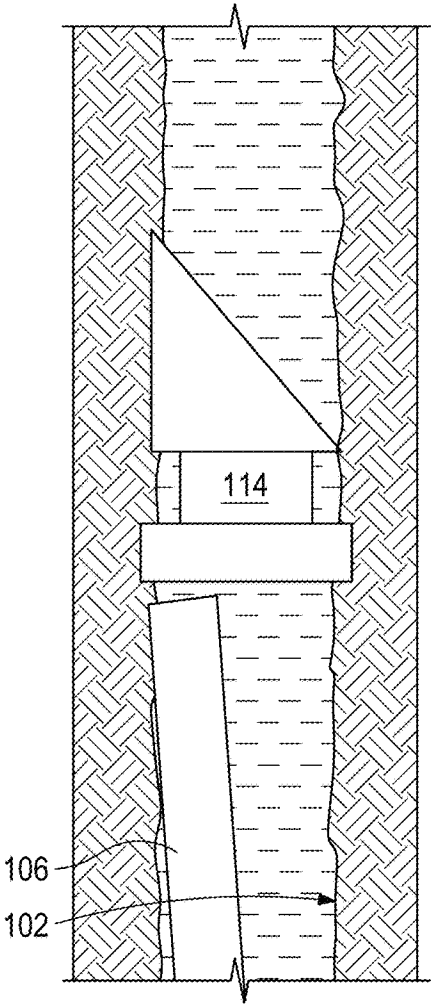
Figure 1A:
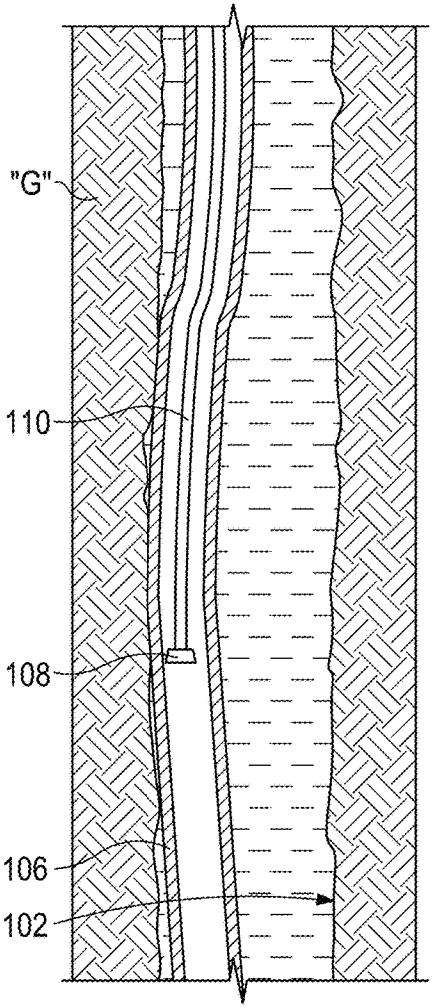

FIGS. 1A through 1C are sequential schematic views for forming a wellbore system 100 including a main wellbore 102 and a sidetrack wellbore 104 extending through a geologic formation "G." The main wellbore 102 may be drilled with a drill string 106, which may become stuck in the main wellbore 102 as illustrated in FIG. 1A. With the drill string 106 stuck, drilling may not be able to continue in the main wellbore 102. However, a cutting tool 108 may be conveyed through the drill string 106 on a conveyance 110 to sever the drill string 106. The cutting tool 108 may include a rotating milling tool, a fluid jet or another mechanism operable to sever the drill string 106 at a desired location, and the conveyance 110 may include coiled tubing, wireline, slickline other elongate conveyances extending to a surface location (not shown).

As illustrated in FIG. 1B, once the drill string 106 is severed, the cutting tool 108 and the conveyance 110 may be withdrawn from the drill string 106, and a freed upper portion of the drill string 106 may be withdrawn from the main wellbore 102. An open hole whipstock 114 may then be conveyed into the main wellbore 102 and installed above the remaining portion of the stuck drill string 106. Next, as illustrated in FIG. 1C, a sidetrack drilling assembly 116 may be run down into the main wellbore 102 to drill the sidetrack wellbore 104. The sidetrack drilling assembly 116 may engage the open hole whipstock 114 and be diverted laterally from the main wellbore 102. The sidetrack drilling assembly 116 may include a drill bit, milling tool or other device for drilling the sidetrack wellbore 104 to the desired depth. This process of drilling the sidetrack wellbore 104 may be time consuming and expensive, particularly since multiple tools must be individually conveyed into the main wellbore 102.

Figure 2:
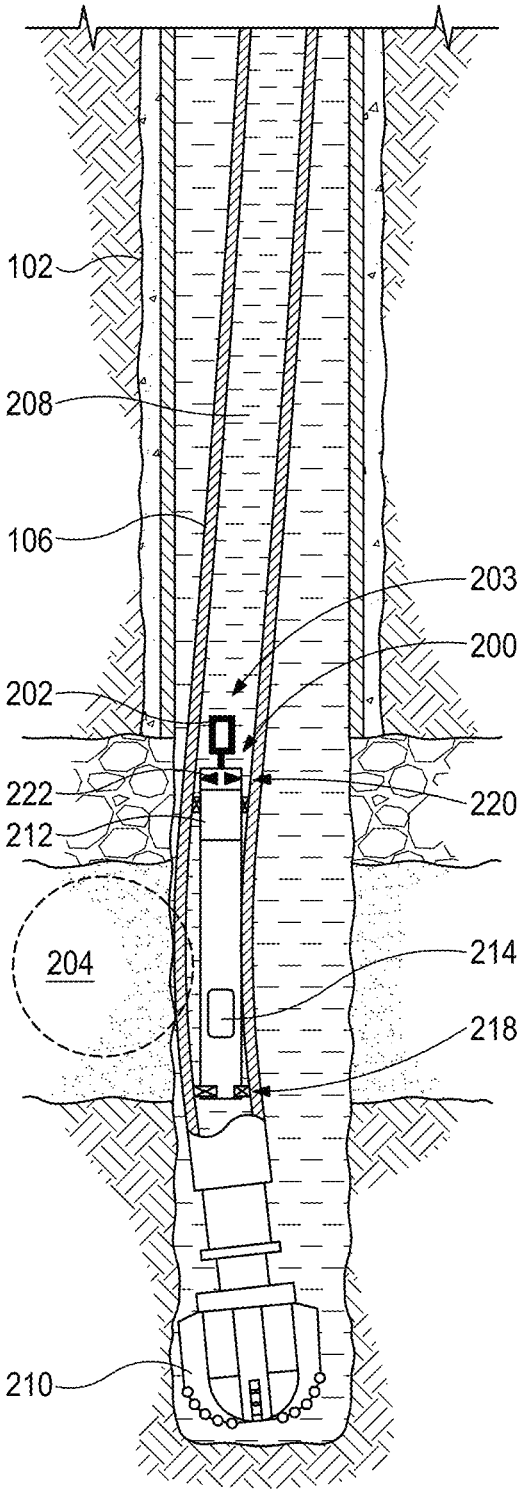
FIG. 2 is a schematic view of a downhole untethered cutting tool deployed in a stuck drill string and including a sidetrack tool integrally coupled to an upper end thereof in accordance with one or more aspects of the present disclosure.

Referring to FIG. 2, a downhole untethered cutting tool 200 is deployed in a stuck drill string 106, and includes a sidetrack tool 202 integrally coupled to an upper end thereof in accordance with one or more aspects of the present disclosure. Together, the untethered cutting tool 200 and the sidetrack tool 202 form an untethered sidetrack tool assembly 203. The drill string 106 is illustrated as making contact with the wall of the main wellbore 102 and getting stuck at a location 204. When the stuck pipe situation is identified, operators may try to free the drill string 106 by various methods, such as spotting acids, using jars, or applying cycles of high-force pick-ups and slack-offs. If the operators are unable to free the stuck drill string 106, the downhole untethered cutting tool 200 may be dropped, pumped or otherwise deployed into the drill string 106.

The downhole untethered cutting tool 200 travels with a drilling fluid 208 at a controlled speed down the drill string 106. The untethered cutting tool 200 is movable through the drill string 106 uncoupled from any wireline, slickline or other downhole conveyance. The flow rate of the drilling fluid 208 controls the travel speed of the downhole untethered cutting tool 200. Although the untethered sidetrack tool assembly 203 may be able to travel all the way to a drill bit 210 at the bottom of the drill string 106, the untethered cutting tool 200 may be activated to fix the untethered cutting tool 200 in position when the untethered cutting tool 200 identifies the stuck pipe location 204 using a sensor module 212. The sensor module 212 senses properties of the drill string 106. More specifically, the sensor module 212 and/or a control unit 214 may identify the stuck point location 204 by detecting a transition between a portion of the drill string 106 in tension and a portion of the drill string 106 in a relaxed state, e.g., only subject to its own weight. The sensor module 212 may include sensors, instrumentation and signal processing circuits, transmitters, receivers, connecting probes, and data storing and processing devices. In some embodiments, the sensor module 212 may generate, for example, magnetic fields or acoustic waves and use fundamental physics phenomena to determine the stuck point location 204 of the drill string 106.

Additionally, or alternatively, the stuck point location 204 may be identified using logging techniques where joints between drill pipes in the drill string 106 are counted and correlated to a depth. Similarly, a downhole pressure may be correlated to a depth to facilitate identification of the stuck point location 204. In some embodiments, the sensor module 212 may measure the magnetic permeability of the drill pipes, and the magnetic permeability may be correlated to internal stresses in the drill string 106. In such applications, the stuck point location 204 may be identified by detecting a change in the internal stress.

Once the stuck point location 204 is successfully identified, the control unit 214 may receive an output from the sensor module 212 and may, in turn, send a signal to open a main valve (not shown) to allow drilling fluid 208 to flow through the untethered cutting tool 200. With the drilling fluid 208 passing through the untethered cutting tool 200, downhole travel of the untethered sidetrack tool assembly 203 stops to maintain a position of the untethered cutting tool 200 in the drill string 106. This may be accomplished by the control unit 214 actuating a locking unit 218 to engage inner surfaces of the drill string 106 and anchor the untethered cutting tool 200 in place. In some embodiments, the locking unit 218 may include one or more inflatable packers, slips or other mechanisms recognized in the art.

The control unit 214 may also send a signal to an actuation unit 220 to extend a plurality of cutting elements 222 from their radially inward running (stowed) position to a radially outward cutting (extended) position in order to engage and sever the stuck drill string 106. Additional details about the construction and operation of the untethered cutting tool 200 may be found in U.S. Pat. No. 11,492,862, which is incorporated herein by reference.

Once the untethered cutting tool 200 severs the drill string 106, the sidetrack tool 202 may be employed to facilitate drilling the sidetrack wellbore 104 (FIG. 1) as described in greater detail below. In some embodiments, the sidetrack tool 202 may be operably coupled to the control unit 214 such that the control unit 214 may operate the sidetrack tool 202.

Referring FIGS. 3A-3D, steps of a downhole operation in which a sidetrack wellbore 104 is drilled from a stuck drill string 106 in a main wellbore 102 using the untethered cutting tool 200 are illustrated. In FIGS. 3A-3D, the sidetrack tool 202 integrally coupled to an upper end of the untethered cutting tool 200 is a pivoting whipstock 302 in accordance with one or more aspects of the present disclosure.

Figure 3D:
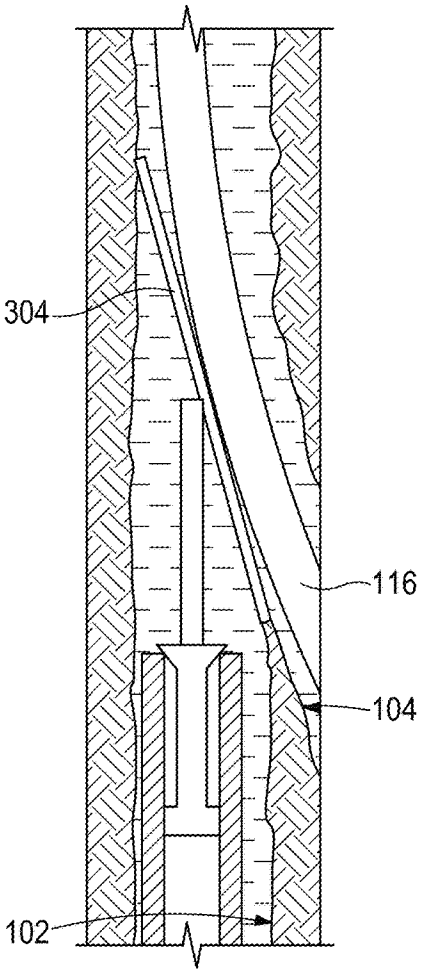
FIGS. 3A-3D are sequential schematic views illustrating steps of a downhole operation in which a sidetrack wellbore is drilled from a stuck drill string in a main wellbore using the untethered cutting tool of FIG. 2 and wherein the sidetrack tool is a pivoting whipstock in accordance with one or more aspects of the present disclosure.
Figure 3C:
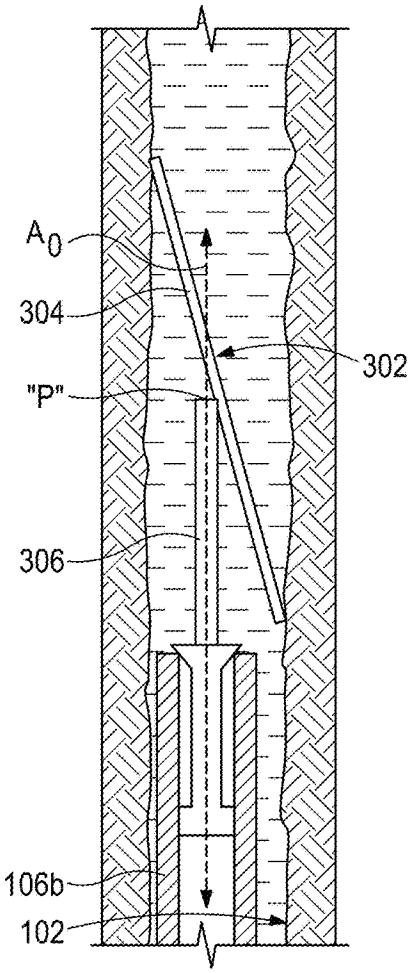
Figure 3B:
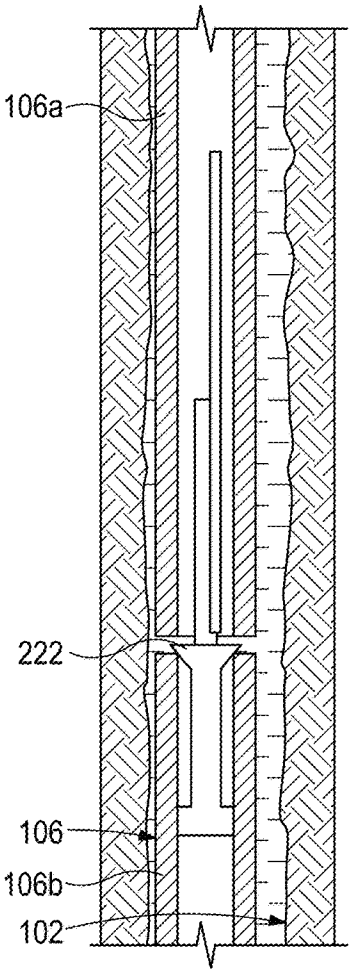
Figure 3A:
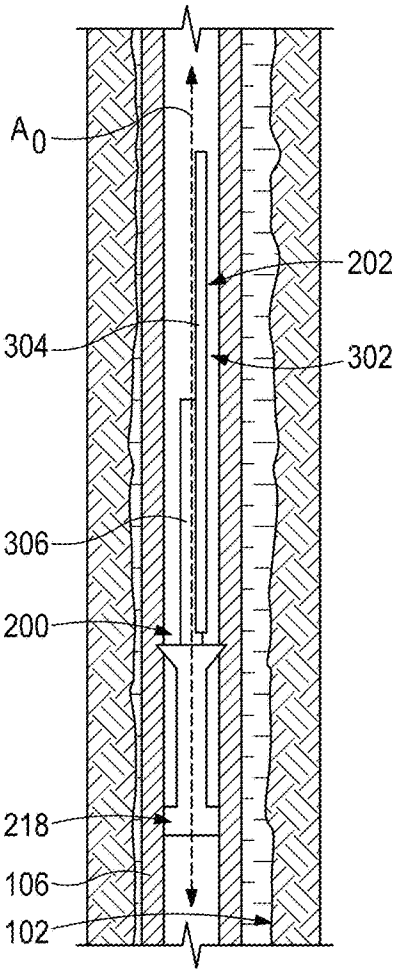

In FIG. 3A, the untethered cutting tool 200 is dropped through the drill string 106 in the main wellbore 102. The pivoting whipstock 302 is arranged in a running configuration wherein a ramp surface 304 is generally aligned or parallel with an axis Ao of the drill string 106. The ramp surface 304 is pivotally coupled to a stationary pedestal 306 extending from the upper surface of the untethered cutting tool 200. A pivot point "P" (see FIG. 3C) is defined between the ramp surface 304 and the pedestal 306 at an upper end of the pedestal 306. With the sidetrack tool 202 in the running configuration, the untethered cutting tool 200 may move freely through the drill string 106. Once the untethered cutting tool 200 reaches a desired location, the locking unit 218 may be activated to secure the untethered cutting tool 200 in the drill string 106. In some embodiments, the untethered cutting tool 200 may be secured in the drill string 106 above a stuck point location 204 (FIG. 2).

In FIG. 3B, the cutting elements 222 may then be operated to sever the drill string 106, and thereby separate an upper portion 106*a* of the drill string 106 from a lower portion 106*b*. Once separated, the upper portion 106*a* may be withdrawn from the main wellbore 102. As illustrated in FIG. 3C, the pivoting whipstock 302 protrudes (extends) above the lower portion 106*b* of the drill string 106, which remains in the main wellbore 102. The pivoting whipstock 302 may be activated to an inclined configuration wherein the ramp surface 304 is inclined with respect to the pedestal 306 and the axis Ao (FIGS. 3A and 3C). The pivoting whipstock 302 may be activated with any hydraulic, pneumatic, electrical, mechanical or other type of mechanism recognized in the art. Once the pivoting whipstock 302 is in the inclined position, the sidetrack drilling assembly 116 may be run into the main wellbore 102 as illustrated in FIG. 3D. The sidetrack drilling assembly 116 may engage the ramp surface 304 and be diverted laterally from the main wellbore 102 to drill the sidetrack wellbore 104 to the desired depth.

FIGS. 4A-4D illustrate steps of an example downhole operation in which the sidetrack wellbore 104 is drilled using the untethered cutting tool 200, and wherein the sidetrack tool 202 is a pivoting whipstock 402 with multiple hinges 404 defined in a pedestal 406 in accordance with one or more aspects of the present disclosure.

Figure 4D:
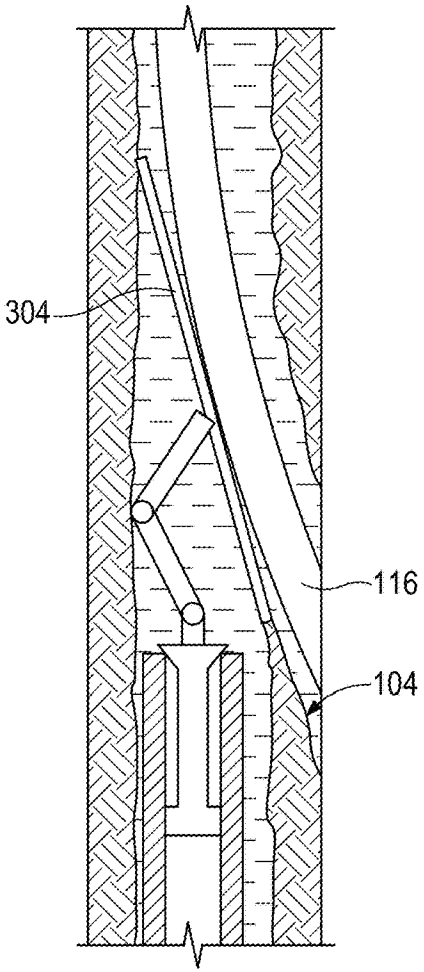
FIGS. 4A-4D are sequential schematic views illustrating steps of a downhole operation in which a sidetrack wellbore is drilled from a stuck drill string in a main wellbore using the untethered cutting tool of FIG. 2 and wherein the sidetrack tool is a pivoting whipstock with multiple hinges in accordance with one or more aspects of the present disclosure.
Figure 4C:
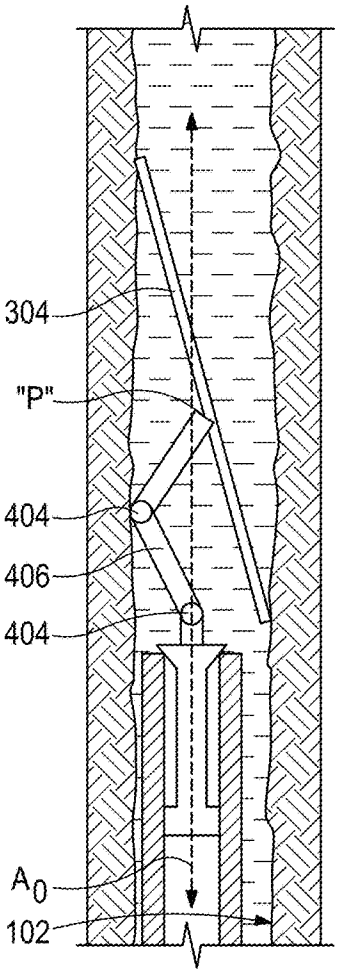
Figure 4B:
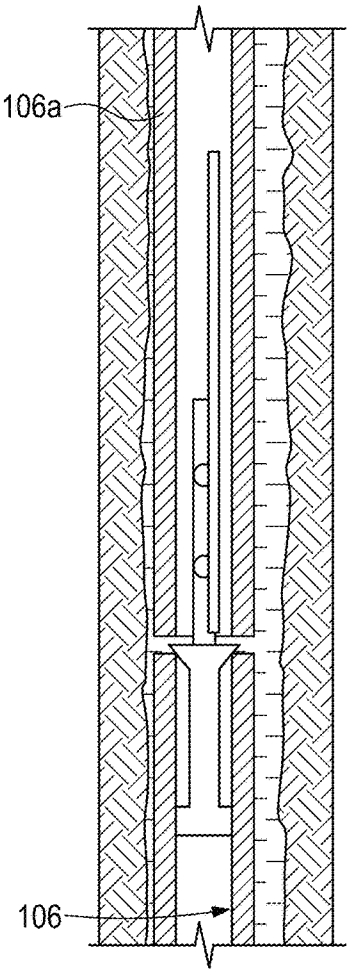
Figure 4A:
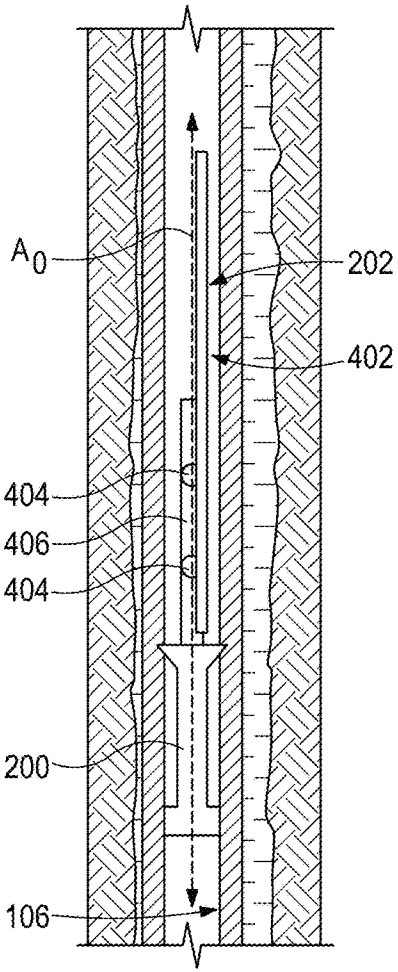

In FIG. 4A, the untethered cutting tool 200 is secured in the drill string 106 with the pivoting whipstock 402 arranged in a running configuration wherein the ramp surface 304 (see FIG. 4C) is generally aligned or parallel with the axis Ao. The drill string 106 may be severed by the untethered cutting tool 200, as illustrated in FIG. 4B, and the upper portion 106*a* may be removed from the main wellbore. The ramp surface 304 may then be pivoted about the pivot point "P" (FIG. 4C) and/or the pedestal 406 may be pivoted about one or more of the hinges 404 as illustrated in FIG. 4C. The hinges 404 may allow the pivoting whipstock 402 to fit within the limited space available within the main wellbore 102. Also, the hinges 404 may allow for better management of reaction forces applied to the walls of the main wellbore 102 by the ramp surface 304. Once the ramp surface 304 is appropriately positioned, the sidetrack drilling assembly 116 may be run down the main wellbore 102 to engage the ramp surface 304 and thereby drill the sidetrack wellbore 104, as depicted in FIG. 4D.

Figures 5A, 5B, 5C, 5D, 5E:
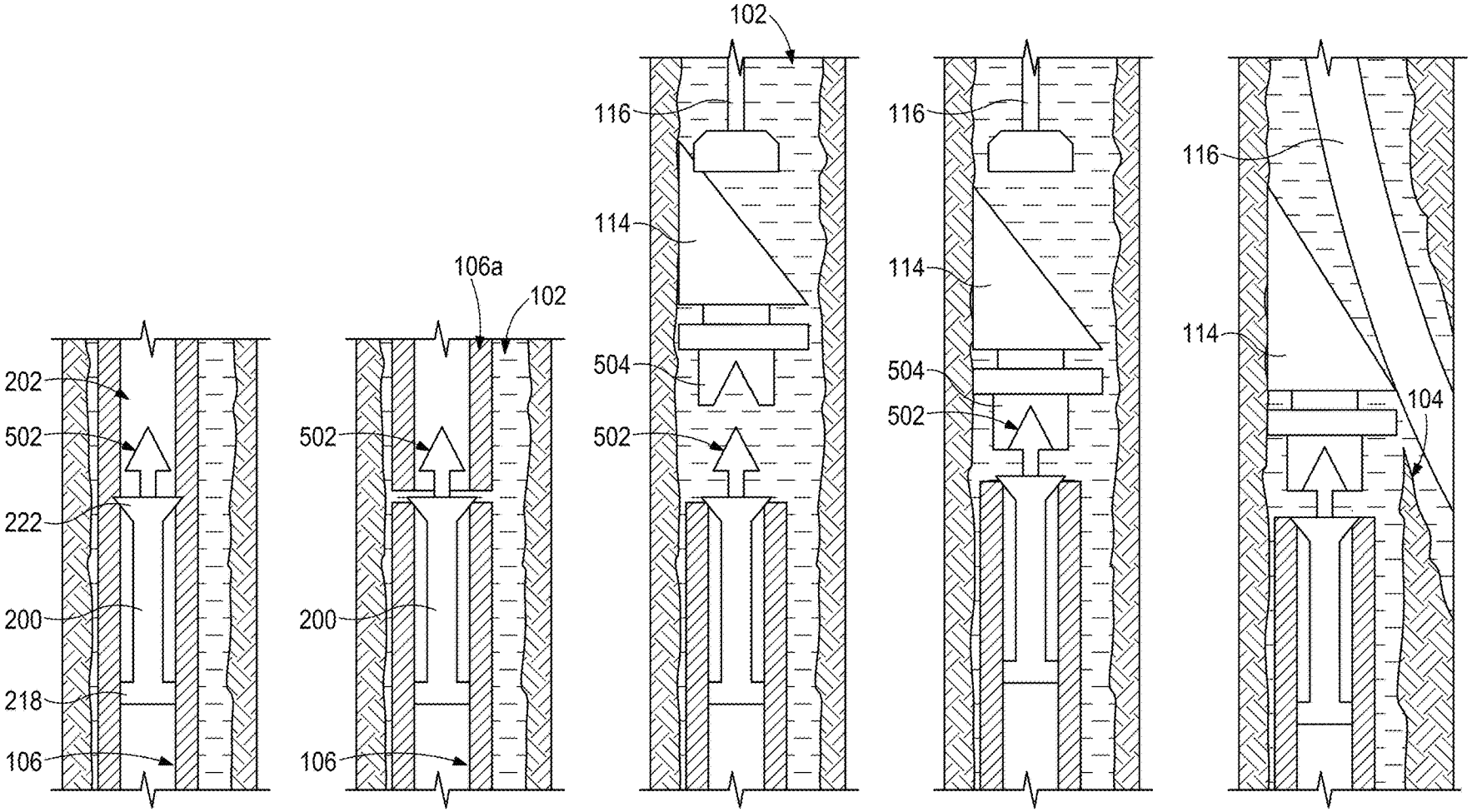
FIGS. 5A-5E are sequential schematic views illustrating steps of a downhole operation in which a sidetrack wellbore is drilled from a stuck drill string in a main wellbore using the untethered cutting tool of FIG. 2 and wherein the sidetrack tool is a whipstock latch in accordance with one or more aspects of the present disclosure.

Referring to FIGS. 5A-5E, steps of a downhole operation in which the sidetrack wellbore 104 is drilled using the untethered cutting tool 200 are illustrated wherein the sidetrack tool 202 comprises a whipstock latch 502 in accordance with one or more aspects of the present disclosure. The whipstock latch 502 is an anchor to which an open hole whipstock 114 (FIGS. 5C-5E) may be coupled to prevent both downward (downhole) motion as well as rotational motion of the open hole whipstock 114 (FIGS. 5C-5E). Initially, the untethered cutting tool 200 may be deployed into the drill string 106 and secured in place using the locking unit 218 (FIG. 5A). The one or more cutting elements 222 may then be activated to sever the drill string 106 (FIG. 5B), as shown in FIG. 5A, and then the upper portion 106*a* of the drill string 106 may be removed from the main wellbore 102 leaving the untethered cutting tool 200 in place with the whipstock latch 502 protruding from an upper end thereof, as shown in FIG. 5B.

In FIG. 5C, the sidetrack drilling assembly 116 may be lowered into the main wellbore 102 with the open hole whipstock 114 coupled to a lower end thereof. A whipstock latch seat 504 is coupled to and otherwise provided at the lower end of the open hole whipstock 114 for engaging the whipstock latch 502. The open hole whipstock 114 may be secured in place by engaging the whipstock latch seat 504 with the whipstock latch 502, and releasing the sidetrack drilling assembly 116, as shown in FIG. 5D. In some embodiments, the open hole whipstock 114 is stationary with respect to the untethered cutting tool 200 once the whipstock latch seat 504 is installed. Once the open hole whipstock 114 is appropriately positioned, as shown in FIG. 5E, the sidetrack drilling assembly 116 may be engaged the open hole whipstock 114 to thereby drill the sidetrack wellbore 104.

Figure 6C:
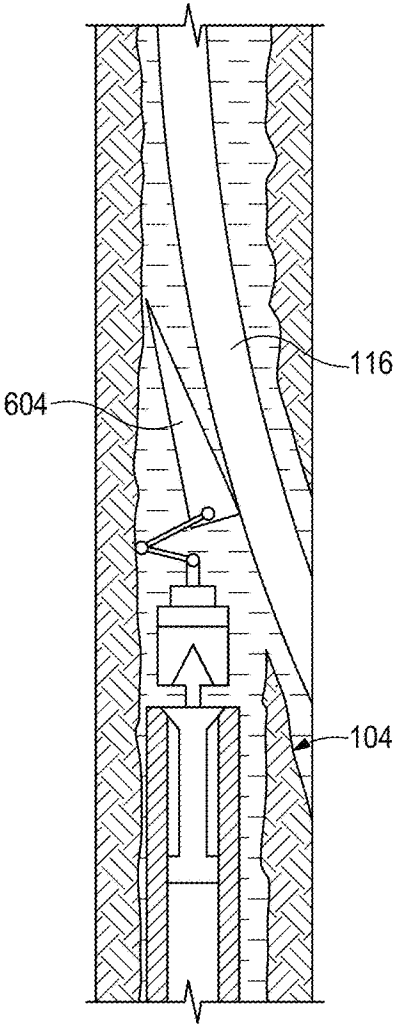
FIGS. 6A-6C are sequential schematic views illustrating steps of a downhole operation in which a sidetrack wellbore is drilled from a stuck drill string in a main wellbore using the untethered cutting tool of FIG. 2 and wherein the sidetrack tool is a whipstock latch for receiving a pivoting whipstock with multiple hinges in accordance with one or more aspects of the present disclosure.
Figure 6B:
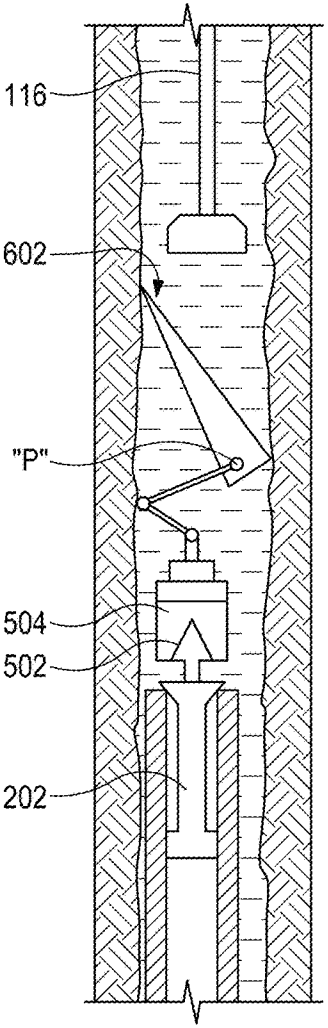
Figure 6A:
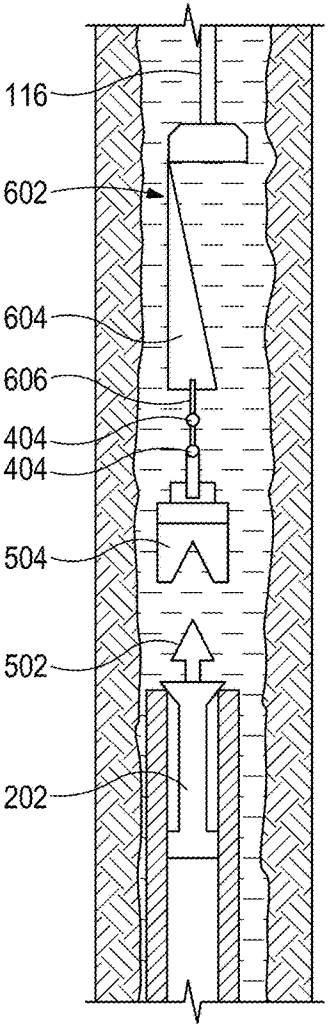

FIGS. 6A-6C illustrate steps of an alternate example downhole operation in which the sidetrack wellbore 104 is drilled using the untethered cutting tool 202 with the whipstock latch 502 coupled to the upper end thereof. A pivoting whipstock 602 is secured to the lower end of the sidetrack drilling assembly 116, as illustrated in FIG. 6A. The pivoting whipstock 602 includes a ramp surface 604 pivotally coupled to a pedestal 606. The pedestal 606 protrudes from the whipstock latch seat 504 and includes one or more hinges 404 allowing the pedestal 606 to pivot. The whipstock latch seat 504 may be engaged with the whipstock latch 502 to prevent axial and rotational motion of the pivoting whipstock 602 with respect to the untethered cutting tool 200, as shown in FIG. 6B. Once the whipstock latch seat 504 is coupled to the whipstock latch 502, the untethered cutting tool 202 may be operably coupled with the pivoting whipstock 602. Thus, the sidetrack drilling assembly 116 may be released from the ramps surface 604, and the control unit 214 (FIG. 2) of the untethered cutting tool 200 may send a control signal to instruct the pivoting whipstock 602 pivot about the pivot point "P" and/or one or more of the hinges 404. In some embodiments, the pivoting whipstock 602 may be spring loaded such that the pivoting whipstock 602 is biased to a desired operational inclined configuration once the control signal is received by the pivoting whipstock 602. The sidetrack drilling assembly 116 may then engage the ramp surface 604 to drill the sidetrack wellbore 104, as shown in FIG. 6C. The hinged design of the pivoting whipstock 602 allows the pivoting whipstock 602 to assume an appropriate orientation to laterally divert the sidetrack drilling assembly 116 while providing a slimmer running configuration.

Figure 7E:
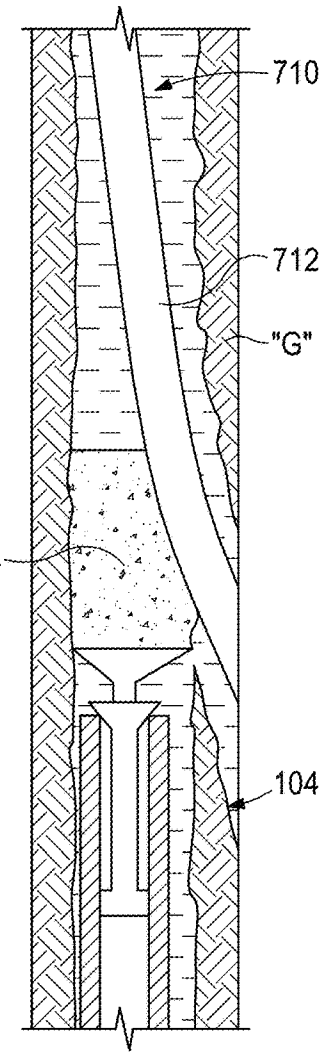
FIGS. 7A-7E are sequential schematic views illustrating steps of a downhole operation in which a sidetrack wellbore is drilled from a stuck drill string in a main wellbore using the untethered cutting tool of FIG. 2 and wherein the sidetrack tool is a cement plug cup in accordance with one or more aspects of the present disclosure.
Figure 7D:
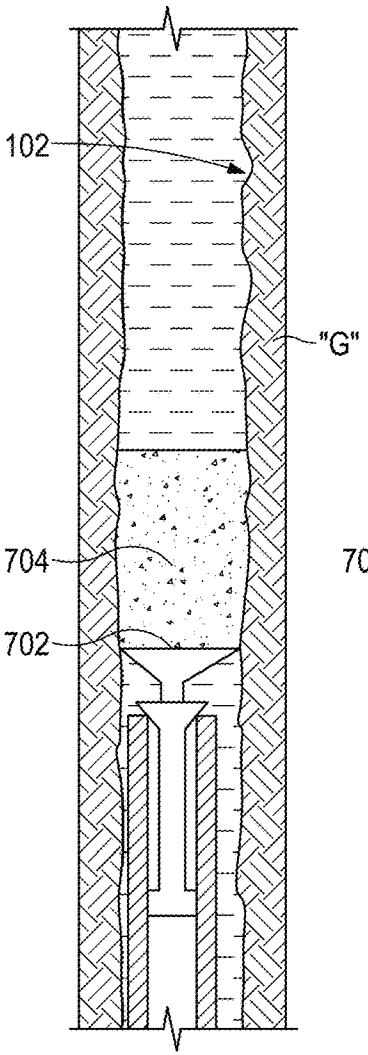
Figure 7C:
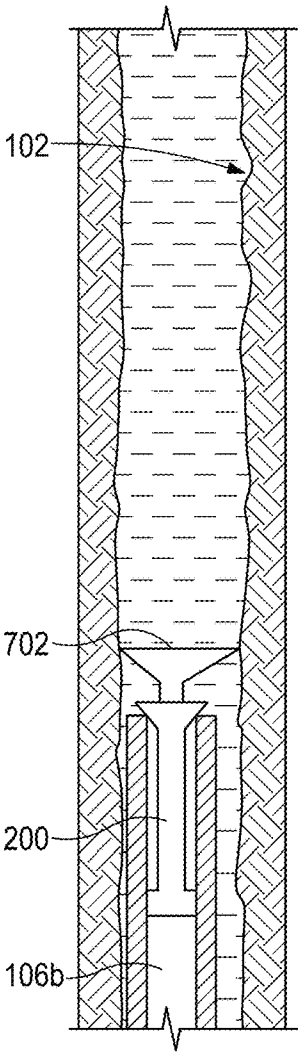
Figure 7B:
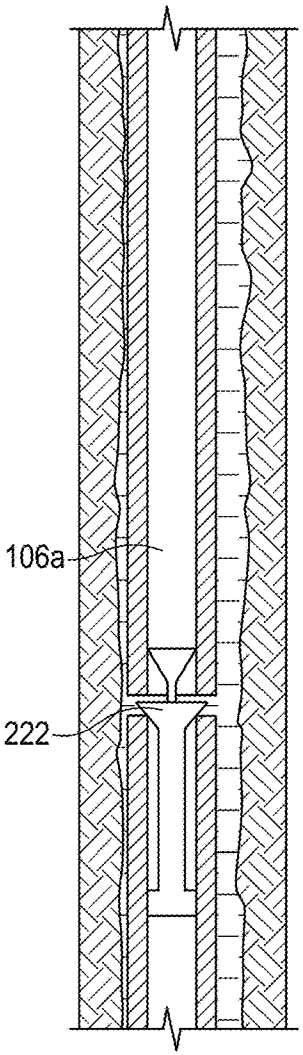
Figure 7A:
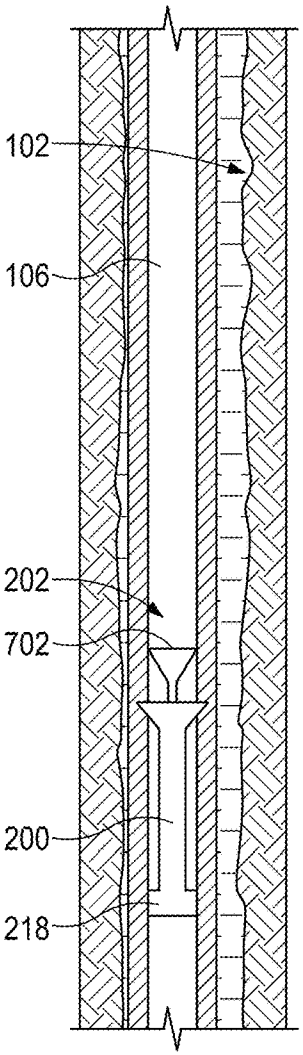

Referring to FIGS. 7A-7E, sequential steps of another example downhole operation are illustrated in which the sidetrack wellbore 104 is drilled from the drill string 106 in a main wellbore 102 using the untethered cutting tool 200. The sidetrack tool 202 integrally coupled to the upper surface of the untethered cutting tool 200 is a cement plug cup 702 in accordance with one or more aspects of the present disclosure. Initially, the untethered cutting tool 200 may be deployed into the drill string 106 and secured in place using the locking unit 218 (FIG. 7A). The one or more cutting elements 222 may then be activated to sever the drill string 106 (FIG. 7B), and then the upper portion 106*a* of the drill string 106 may be removed from the main wellbore 102 leaving the untethered cutting tool 200 in place with the cement plug cup cement plug cup 702 protruding from an upper end thereof.

As illustrated in FIG. 7C, the cement plug cup 702 may be selectively expanded to extend across the main wellbore 102. For example, the cement plug cup 702 may be unfolded, inflated or otherwise expanded to form a seal across the main wellbore 102 above the untethered cutting tool 200 and the lower portion 106*b* of the drill string 106. A cement plug 704 may then be formed above the cement plug cup 702, as shown in FIG. 7D. For example, a cement string (not shown) may be run into the main wellbore to deliver cement to the cement plug cup 702 that may solidify to form the cement plug 704. Alternatively, the freed upper portion 106*a* of the drill string 106 may be used to deliver cement therethrough to the cement plug cup 702 that may solidify to form the cement plug 704. In some embodiments, the cement plug 704 may be a balanced plug formed from cement having a density substantially equivalent to a density of a wellbore fluid the main wellbore 102. Density-driven mixing while the cement hardens may thereby be discouraged or eliminated. Once hardened, the cement plug 704 may be harder than the geologic formation "G" surrounding the main wellbore 102.

Once the cement plug 704 is hardened, a specialized sidetrack drilling assembly 710 may be run into the main wellbore to engage the cement plug 704. The drilling assembly 710 may include a pendulum bottom hole assembly (BHA) (not shown), which may have tendency to progress in a lateral direction (as opposed to a stiff BHA, which may have a tendency to drill straight). To facilitate the lateral drilling, the pendulum BHA may be equipped with a downhole drilling motor that rotates a sidetrack drill bit (not shown) when drilling fluid is pumped therethrough without rotating a sidetrack drill string 712.

As recognized by those skilled in the art, a drilling technique called "time-drilling" may be used in which a minimum weight is applied to the sidetrack drilling assembly 710 for several hours with a rate of penetration kept below 1 or 2 feet per hour. The sidetrack drill bit may be rotated by the drilling motor, and because cement plug 704 is harder than the geologic formation "G", and because the applied weight is minimized, the pendulum BHA will drill laterally more than axially through the cement plug 704. When it is observed that drill cuttings returned to the surface include material from the geologic formation "G" rather than the cement plug 704, the time drilling may be ended, and normal drilling may proceed so advance the sidetrack drilling assembly 710 along the sidetrack wellbore 104.

Embodiments Disclosed Herein Include

A. A wellbore system can include a drill string extending into a main wellbore and an untethered cutting tool disposed within the drill string. The untethered cutting tool can include a locking unit operable to fix a location of the untethered cutting tool in the drill string and at least one cutting element operable to sever the drill string. The wellbore system can also include a sidetrack tool integrally coupled to an upper end of the untethered cutting tool. The sidetrack tool can include at least one of the group consisting of a whipstock, a whipstock latch, and a cement plug cup.

B. A method for forming a sidetrack wellbore can include (a) deploying an untethered cutting tool into a drill string extending into a main wellbore, (b) fixing a location of the untethered cutting tool in the drill string with a locking unit of the untethered cutting tool, (c) severing the drill string with at least one cutting element of the untethered cutting tool, (d) withdrawing an upper portion of the drill string from the wellbore, and (e) engaging a sidetrack tool integrally coupled to an upper end of the untethered cutting tool with a sidetrack drilling assembly, a whipstock latch seat or a cement plug to direct the sidetrack drilling assembly laterally from the main wellbore to form the sidetrack wellbore.

C. An untethered sidetrack tool assembly can include an untethered cutting tool movable through a drill string uncoupled from any conveyance. The untethered cutting tool can include a locking unit operable to fix a location of the untethered cutting tool with respect to the drill string and at least one cutting element operable to sever the drill string. A sidetrack tool can be integrally coupled to an upper end of the untethered cutting tool. The sidetrack tool can include at least one of the group consisting of a whipstock, a whipstock latch, and a cement plug cup.

Each of embodiments A, B, and C may have one or more of the following additional elements in any combination: Element 1: wherein the whipstock includes a pivoting whipstock, and wherein the pivoting whipstock includes a ramp surface pivotally coupled to a pedestal extending from the upper end of the sidetrack tool. Element 2: wherein the pedestal includes at least one hinge defined therein, and wherein the pivoting whipstock is movable between a running configuration wherein he pedestal and the ramp surface are aligned with an axis of the drill string and an inclined operational configuration wherein the ramp surface and at least a portion of the pedestal are inclined with respect to the axis of the drill string. Element 3: further comprising a whipstock latch seat selectively engageable with the whipstock latch to prohibit axial and rotational motion of the whipstock with respect to the untethered cutting tool. Element 4: further comprising sidetrack drilling assembly, and wherein the whipstock and the whipstock latch are selectively releasable from a lower end of the sidetrack drilling assembly. Element 5: wherein the whipstock is an open hole whipstock stationary with respect to the untethered cutting tool when the whipstock latch set is engaged with the whipstock latch. Element 6: wherein the cement plug cup is selectively expandable to form a seal across the main wellbore above the untethered cutting tool. Element 7: further comprising a cement plug formed above the cement plug cup in the main wellbore.

Element 8: further comprising identifying a stuck point location of the drill string within the main wellbore, and wherein fixing the location of the untethered cutting tool includes fixing the untethered cutting tool above the stuck point location in the wellbore. Element 9: further comprising pivoting a ramp surface of the whipstock with respect to a pedestal extending from the upper end of the untethered cutting tool subsequent to withdrawing the upper portion of the drill string from the wellbore. Element 10: further comprising pivoting the pedestal about one or more hinges subsequent to withdrawing the upper portion of the drill string from the wellbore. Element 11: wherein engaging the sidetrack tool includes engaging the whipstock latch seat with a whipstock latch to thereby prohibit rotational and axial motion of the whipstock with respect to the untethered cutting tool. Element 12: further comprising releasing the whipstock and the whipstock latch seat from the sidetrack drilling assembly subsequent to engaging the sidetrack tool. Element 13: wherein engaging the sidetrack tool includes expanding a cement plug cup to form a seal across the main wellbore and forming the cement plug on the cement plug cup. Element 14: wherein forming the cement plug includes forming a balanced plug of cement having a density substantially equivalent to a density of a wellbore fluid the main wellbore.

Element 15: wherein the untethered cutting tool further comprises a sensor module operable to detect a characteristic indicative of a stuck point location of the drill string within a main wellbore. Element 16: wherein the whipstock includes a pivoting whipstock, and wherein the pivoting whipstock includes a ramp surface pivotally coupled to a pedestal extending from the upper end of the sidetrack tool, and wherein the pedestal includes one or more hinges defined therein. Element 17: wherein the cement plug cup is selectively expandable to form a seal across a main wellbore above the untethered cutting tool.

By way of non-limiting example, exemplary combinations applicable to A, B, and C include: Element 1 with Element 2; Element 3 with Element 4; Element 3 with Element 5; Element 6 with Element 7; Element 9 with Element 10; Element 11 with Element 12; Element 13 with Element 14; and Element 15 with Element 16.

The terminology used herein is for the purpose of describing particular embodiments only and is not intended to be limiting of the invention. As used herein, for example, the singular forms "a," "an," and "the" are intended to include the plural forms as well, unless the context clearly indicates otherwise. It will be further understood that the terms "contains", "containing", "includes", "including," "comprises", and/or "comprising," and variations thereof, when used in this specification, specify the presence of stated features, integers, steps, operations, elements, and/or components, but do not preclude the presence or addition of one or more other features, integers, steps, operations, elements, components, and/or groups thereof.

Terms of orientation are used herein merely for purposes of convention and referencing and are not to be construed as limiting. However, it is recognized these terms could be used with reference to an operator or user. Accordingly, no limitations are implied or to be inferred. In addition, the use of ordinal numbers (e.g., first, second, third, etc.) is for distinction and not counting. For example, the use of "third" does not imply there must be a corresponding "first" or "second." Also, if used herein, the terms "coupled" or "coupled to" or "connected" or "connected to" or "attached" or "attached to" may indicate establishing either a direct or indirect connection, and is not limited to either unless expressly referenced as such. While the disclosure has described several exemplary embodiments, it will be understood by those skilled in the art that various changes can be made, and equivalents can be substituted for elements thereof, without departing from the spirit and scope of the invention. In addition, many modifications will be appreciated by those skilled in the art to adapt a particular instrument, situation, or material to embodiments of the disclosure without departing from the essential scope thereof. Therefore, it is intended that the invention not be limited to the particular embodiments disclosed, or to the best mode contemplated for carrying out this invention, but that the invention will include all embodiments falling within the scope of the appended claims. Moreover, reference in the appended claims to an apparatus or system or a component of an apparatus or system being adapted to, arranged to, capable of, configured to, enabled to, operable to, or operative to perform a particular function encompasses that apparatus, system, or component, whether or not it or that particular function is activated, turned on, or unlocked, as long as that apparatus, system, or component is so adapted, arranged, capable, configured, enabled, operable, or operative.

The invention claimed is:

1. A wellbore system, comprising:

a drill string extending into a main wellbore;

an untethered cutting tool disposed within the drill string and including a locking unit operable to fix a location of the untethered cutting tool in the drill string and at least one cutting element operable to sever the drill string; and a sidetrack tool integrally coupled to an upper end of the untethered cutting tool and including at least one of the group consisting of a radially extendable whipstock, a whipstock latch protruding from an upper end of the untethered cutting tool for receiving a broad profile whipstock thereon that is radially wider than the untethered cutting tool, and a selectively expandable cement plug cup.

2. The wellbore system of claim 1, wherein the radially extendable whipstock includes a pivoting whipstock, and the pivoting whipstock includes a ramp surface pivotally coupled to a pedestal extending from the upper end of the sidetrack tool.

3. The wellbore system of claim 2, wherein the pedestal includes at least one hinge and the pivoting whipstock is movable between a running configuration, where the pedestal and the ramp surface are aligned with an axis of the drill string, and an inclined operational configuration, where the ramp surface and at least a portion of the pedestal are inclined with respect to the axis of the drill string.

4. The wellbore system of claim 1, wherein the whipstock latch seat is selectively engageable with the broad profile whipstock latch to prohibit axial and rotational motion of the broad profile whipstock with respect to the untethered cutting tool.

5. The wellbore system of claim 4, further comprising a sidetrack drilling assembly, wherein the broad profile whipstock and the whipstock latch are selectively releasable from a lower end of the sidetrack drilling assembly.

6. The wellbore system of claim 5, wherein the broad profile whipstock is an open hole whipstock that is stationary with respect to the untethered cutting tool when the whipstock latch seat is engaged with the whipstock latch.

7. The wellbore system of claim 1, wherein the cement plug cup is selectively expandable to form a seal across the main wellbore above the untethered cutting tool.

8. The wellbore system of claim 7, further comprising a cement plug formed above the cement plug cup in the main wellbore.

9. A method for forming a sidetrack wellbore, comprising:

deploying an untethered cutting tool into a drill string extending into a main wellbore;

fixing a location of the untethered cutting tool in the drill string with a locking unit of the untethered cutting tool;

severing the drill string with at least one cutting element of the untethered cutting tool;

withdrawing an upper portion of the drill string from the wellbore;

engaging a sidetrack drilling assembly with a whipstock being either integrally coupled to an upper end of the untethered cutting tool or latched to a whipstock latch seat integrally coupled to the upper end of the untethered cutting tool, the whipstock being operable to direct the sidetrack drilling assembly laterally from the main wellbore to form the sidetrack wellbore; and pivoting a ramp surface of the whipstock radially outward from the drill string subsequent to withdrawing the upper portion of the drill string from the wellbore and prior to directing the sidetrack assembly laterally.

10. The method of claim 9, further comprising identifying a stuck point location of the drill string within the main wellbore, and wherein fixing the location of the untethered cutting tool comprises fixing the untethered cutting tool above the stuck point location in the wellbore.

11. The method of claim 9, wherein pivoting the ramp surface of the whipstock includes pivoting the ramp surface with respect to a pedestal extending from the upper end of the untethered cutting tool.

12. The method of claim 9, further comprising pivoting the pedestal about one or more hinges subsequent to withdrawing the upper portion of the drill string from the wellbore.

13. The method of claim 9, wherein engaging the sidetrack tool includes engaging the whipstock latch seat with a whipstock latch to thereby prohibit rotational and axial motion of the whipstock with respect to the untethered cutting tool.

14. The method of claim 13, further comprising releasing the whipstock and the whipstock latch seat from the sidetrack drilling assembly subsequent to engaging the sidetrack tool.

15. An untethered sidetrack tool assembly, comprising:

an untethered cutting tool movable through a drill string uncoupled from any conveyance, the untethered cutting tool including:

a locking unit operable to fix a location of the untethered cutting tool with respect to the drill string; and at least one cutting element operable to sever the drill string; and a cement plug cup integrally coupled to an upper end of the untethered cutting tool, the cement plug cup selectively expandable to form a seal across a main wellbore above the untethered cutting tool.

16. The untethered sidetrack tool assembly of claim 15, wherein the untethered cutting tool further comprises a sensor module operable to detect a characteristic indicative of a stuck point location of the drill string within a main wellbore.

17. The untethered sidetrack tool assembly of claim 15, wherein the cement plug cup is selectively unfolded or inflated.

18. The untethered sidetrack tool assembly of claim 15, wherein the untethered cutting tool further comprises a sensor module operable to detect a characteristic indicative of a stuck point location of the drill string within the main wellbore.

19. The untethered sidetrack tool assembly of claim 18, wherein the sensor module is operable to detect a transition between a portion of the drill string in tension and a portion of the drill string in a relaxed state.

20. The untethered sidetrack tool assembly of claim 19, wherein the sensor module is operable to measure a magnetic permeability of the drill string and correlate the magnetic permeability to an internal stress in the drill string.

* * * * *